United States Patent [19]

Burleson

[11] Patent Number: 4,688,490

[45] Date of Patent: Aug. 25, 1987

[54] RAIL CAR DOOR BOTTOM GUIDE RAIL HAVING TIRE-ACTUATED, DEPRESSIBLE SECTIONS

[75] Inventor: Robert M. Burleson, Adamsville, Pa.

[73] Assignee: Greenville Steel Car Company, Greenville, Pa.

[21] Appl. No.: 783,943

[22] Filed: Oct. 3, 1985

[51] Int. Cl.[4] ..... B61D 3/18; E05B 65/14; B60J 5/10

[52] U.S. Cl. ..... 105/378; 16/96 R; 49/411; 160/201

[58] Field of Search ..... 410/26, 27; 105/378, 105/436, 410, 458, 459; 14/69.5, 71.1; 49/404, 409–411, 372, 131–133, 262, 263, 273, 274; 414/537; 280/403; 160/196 R, 196 D, 199, 201, 206, 214; 16/90, 91, 96 R

[56] References Cited

U.S. PATENT DOCUMENTS

| | | | |
|---|---|---|---|
| 1,649,877 | 11/1927 | Walston | 49/273 |
| 1,750,989 | 3/1930 | Bradfield | 160/199 |
| 4,077,330 | 3/1978 | Peisner et al. | 410/26 X |
| 4,097,170 | 6/1978 | Dickinson | 49/131 X |
| 4,116,135 | 9/1978 | Jaekle et al. | 410/26 |
| 4,437,410 | 3/1984 | Stoller, Sr. et al. | 410/26 X |
| 4,598,499 | 7/1986 | Viner | 49/411 |

FOREIGN PATENT DOCUMENTS

| | | | |
|---|---|---|---|
| 0588007 | 5/1977 | Switzerland | 49/410 |

*Primary Examiner*—Robert B. Reeves
*Assistant Examiner*—Scott H. Werny
*Attorney, Agent, or Firm*—Webb, Burden, Robinson & Webb

[57] ABSTRACT

A railroad car arranged to transport automobiles comprises a floor, a roof, a pair of spaced sidewalls, and at least one door assembly that is guided to a position adjacent a sidewall to enable loading and unloading of the rail car. A rail guides the lower end of the door assembly. The rail is positioned along the floor of the rail car. A plurality of fingers attached to the door assembly and extend to a sliding engagement with the rail. The rail has uninterrupted sections and extends substantially entirely across the floor between the sidewalls and has two spaced depressible sections that are pushed down by the tires of automobiles rolling thereover. Each depressible section comprises a predetermined length of guide rail, springs for biasing said guide rail upwardly, and preferably, a slotted channel through which said guide rail partially extends.

14 Claims, 4 Drawing Figures

RAIL CAR DOOR BOTTOM GUIDE RAIL HAVING TIRE-ACTUATED, DEPRESSIBLE SECTIONS

BACKGROUND OF THE INVENTION

For railroad cars adapted to carry automobiles, it is essential that the cargo be enclosed to protect it from theft of components. Such railroad cars are provided with sidewalls, a roof spanning the sidewalls and ends that are closed off by doors. Typically, the railroad cars are designed to have a floor and either one or two intermediate decks supported above the floor for holding the automobiles loaded thereon. The automobiles are driven from platforms at the end of the railroad car onto either the floor or a deck for loading.

The height of the railroad car is a critical matter. Due to limitations (underpasses, tunnels, and the like) along the railroad, the height of the car is restricted. Especially, in the case of a car designed for three levels, i.e. having two decks supported above the floor, the total height of each automobile is thus limited by the height of the roof above the floor and by the width of the decks. A saving of two or three inches can be of great significance.

A number of end closure (door) designs are known for railroad cars of the type being discussed. Usually, the doors slide from the closed position to a position along the inside of the sidewalls. A suitable guide track or rail is provided adjacent the bottom edges of the door. The guide rail does not hinder the operation of the door and provides security by restricting the outward movement of the lower end of the door. Thus, access may not be gained to the interior of the railroad car by pulling out of the bottom edges of the doors away from the end opening.

The guide track or rail must extend upward from the floor at the end of the car. This extension, undesirably, takes two or three inches away from the effective floor to roof distance of the enclosed railroad car. Actually, where it is necessary to bridge the rail with a plank, or the like, the floor to roof distance is even further diminished.

It is an advantage according to this invention to provide a railroad car adapted to carry automobiles having end closures with bottom guide rails that do not diminish the effective distance between the floor and roof of the railroad car.

SUMMARY OF THE INVENTION

Briefly according to this invention, there is provided an improved railroad car arranged to transport automobiles. The railroad car comprises a floor, a roof, and a pair of spaced sidewalls. At least a door assembly and guide means for guiding the door assembly are positioned adjacent to an end opening to enable loading and unloading of the railroad car. A rail for guiding the lower end of the door assembly is positioned along the floor of the railroad car. Fingers attached to the door assembly extend to the rail, straddle the rail and are in sliding engagement therewith. The improvement according to this invention is that a rail having uninterrupted sections extends substantially entirely across the floor between the sidewalls and the rail has two spaced, depressible sections that can be pushed down by the tires of the automobiles rolling thereover.

THE DRAWINGS

Further features and other objects and advantages of this invention will become clear from the following detailed discussion made with reference to the drawings in which FIG. 1 is an end view of a rail car above the frame;

DESCRIPTION OF THE PREFERRED EMBODIMENTS

Figure 1:
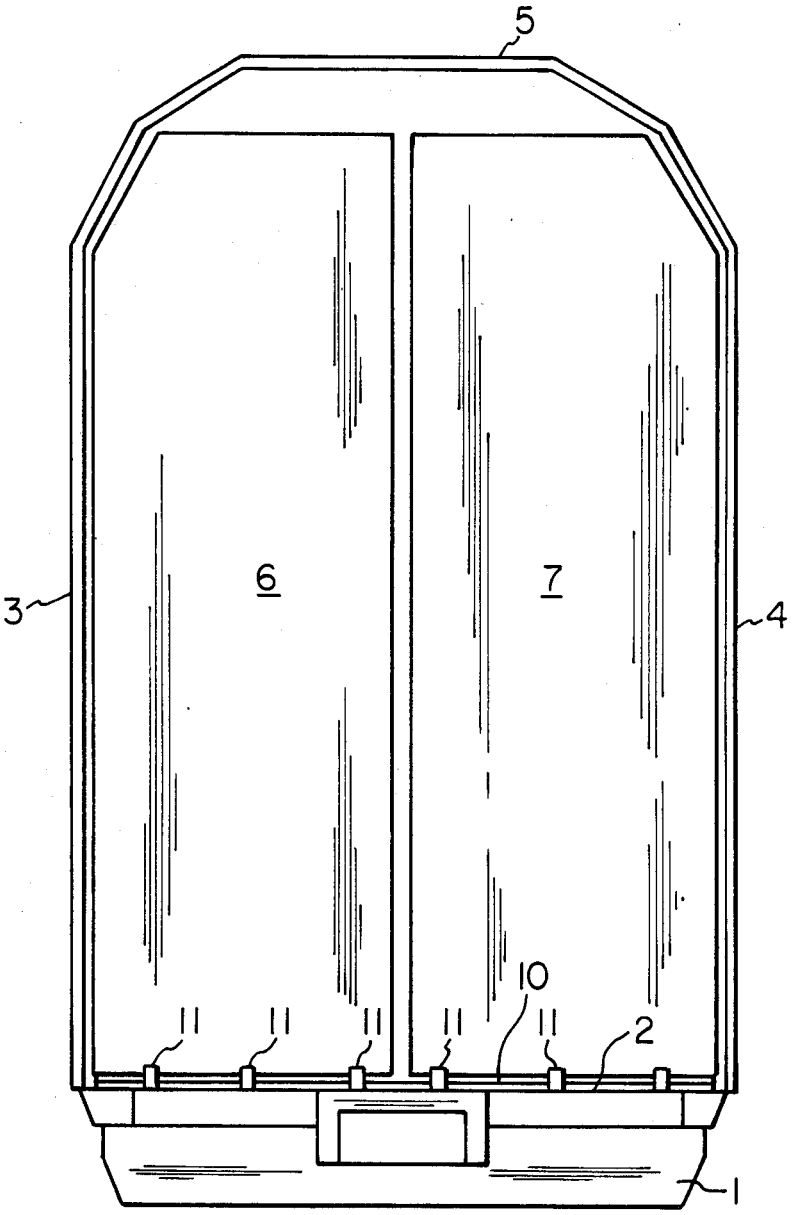

Referring now to FIG. 1, there is shown the end of a railroad car designed to carry automobiles. The railroad car includes a frame 1 upon which is positioned a floor 2. Sidewalls 3, 4 rise from the floor and are spaced apart the width of the railroad car. For simplicity, the wheels and axles of the railroad car are not shown. A roof 5 spans the space between the sidewalls. A pair of doors 6, 7 are arranged to close off the end of the railroad car. Typically, the doors are arranged to slide back along the sidewalls to an open or stowed position.

The support member (not shown in the drawings) from which the doors are hung for sliding between closed and opened positions is generally arranged midway between the floor and the roof. Various support members have been designed depending upon the configuration of the doors. The particular construction of the doors and support member forms no part of this invention.

With the doors of the type described, there must be a guide track or rail 10 adjacent the bottom edges of the doors when they are in the closed position. A plurality of fingers 11 extend from the lower edge of the doors and straddle the rail. Thus, when the doors are in the closed position, the lower end portions of the doors cannot be forced outward preventing unauthorized access to the railroad car interior.

Figure 2:
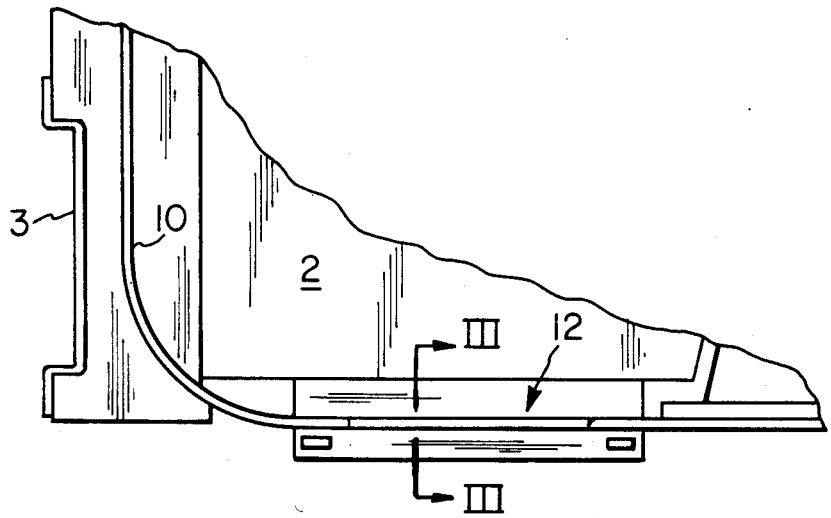
FIG. 2 is a plan view of the end of the rail car shown in FIG. 1.

Referring now to FIG. 2, the edge of the floor 2 in the vicinity of the rail 10 is shown. The rail, according to this invention, has uninterrupted sections and extends from side to side of the railroad car. It is provided with a tire actuated, depressible rail section 12 on each side of the car. The depressible sections 12 are spaced from a hypothetical center line of the railroad car an equal distance such that automobile wheels will travel over the sections when the center of an automobile is aligned with the center line of the railroad car.

Figure 3:
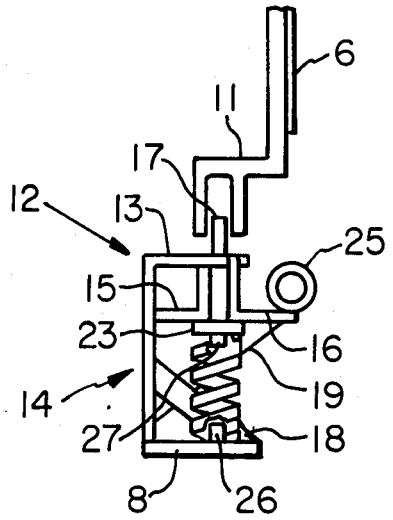
FIG. 3 is a section view taken along line III—III on FIG. 2.
Figure 4:
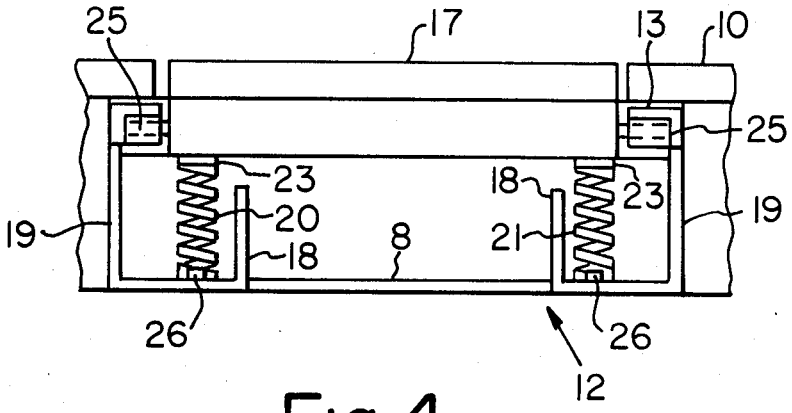
FIG. 4 is an elevation view of a portion of the depressible rail section according to this invention.

FIGS. 3 and 4 show in more detail one of the depressible rail sections 12 generally. A predetermined length of guide rail 17 passes through a slot provided in the horizontal web 13 of end angle 14. The end angle 14 is welded to a base plate 8. The base plate 8 is secured to the frame of the railroad car. Support angle 15 is welded to the interior of end angle 14 so that one web of the support angle 15 is adjacent the guide rail 17. A hinge support angle 16 is also welded to the end angle 14 with one web adjacent the guide rail 17 and another web extending outwardly toward the end of the railroad car. The web extending outwardly from the railroad car is positioned downwardly from the upper web 13 of the end angle. The entire structure is made rigid by angles braces 18 and 19. Together, the entire structure comprises a slotted channel through which the guide rail 17 partially extends.

Beneath the horizontal web 13 of the end angle 14 are means for biasing the guide rail 17 upwardly. A plurality of stops 23 are welded to the bottom of the guide rail 17 to restrict its maximum upward movement by bearing upon the horizontal web of support angle 15 and of hinge support angle 16.

Tube sections 25 are welded to the top surface of the horizontal web of the hinge angle 16. The outer diameter of each tube section 25 is less than the width of the vertical web of the hinge support angle 16. Thus, the tubes are lower than the horizontal web 13. The tube sections 25 are standard for rail cars of this type and form the fixed portion of the hinge to be described. A bridge plate (not shown) is welded to a long tube section of a length to fit between the tube sections 25. The long tube section may be arranged so that a rod can be passed through tube sections 25 and the long tube section welded to the bridge plate. Thus the bridge plate is temporarily secured to the rail car for aligning the automobiles with the floor of the rail car during loading and unloading.

The support angle 15 and the hinge support angle 16 both have faces of vertical webs adjacent to the guide rail 17 to serve as guides for the rail and to prevent it from being rotated back or forward even in its most upward position. The width (top to bottom) of the vertical webs adjacent the rail should be at least as great as one-half the width (top to bottom) of the guide rail of each depressible rail section 12. The guide rail 17, itself, should be sufficiently wide such that even in its most upward position, at least one-half of the rail 17 remains below the top web 13 of the channel.

The springs 20, 21 that comprise the biasing means in the preferred embodiment are cylindrical helical springs having circular cross-sections. Each spring has a lower guide comprising a tube section 26 outside the spring coils welded to the base and a tubular guide 27 positioned within the spring coil and welded to either the guide rail 17 or stops 23.

The strength of the springs 20, 21 should be selected such that only by the weight of the automobile transmitted through one wheel can they be depressed. The maximum force constant (pounds/inch) for the two springs may be calculated by multiplying the minimum wheel weight by the height of the rail above the web (in inches) and dividing by two. The minimum wheel weight is the minimum amount of weight a wheel will exert on the rail section 12 when placed upon it. The force constant can be well below the maximum so long as the rail section is not easily depressible by hand.

The rail section 12 should not be depressible by hand. Thus, the rail cannot be easily pressed downwardly and pulled away at the bottom to permit access. Even if the rail could be depressed by some manual means, the portions of the rail 10 adjacent the depressible rail section 12 will remain engaged with fingers 11 attached to the door. Therefore, only with considerable difficulty can the security of the railroad can be breached by pulling out the lower end of the door. When the door is opened and automobiles are being loaded, however, the guide rail 17 of the depressible section 12 is easily depressed allowing an automobile to pass over without rising as it passes.

Having thus described the invention with the detail and particularity required by the Patent Laws, what is desired by Letters Patent is set forth in the following claims.

I claim:

1. In a railroad car arranged to transport automobiles, said railroad car comprising a floor, a roof, a pair of spaced sidewalls, at least one door assembly having a lower end and guide means for guiding the door assembly to a position adjacent a sidewall to enable loading and unloading of the railroad car, a rail for guiding the lower end of the door assembly, said rail positioned along the floor of the railroad car, means attached to the door assembly and extending to a sliding engagement with the rail, the improvement comprising said rail having uninterrupted sections and extending substantially entirely across the floor between the sidewalls and said rail having two spaced, tire-actuated depressible sections that are pushed down by the tires of the automobiles rolling thereover in both a loading and an unloading direction.

2. The improvement as claimed in claim 1, wherein said depressible sections are spaced from a hypothetical center line of the railroad car an equal distance such that automobile wheels will travel over said sections when the center of an autombile is aligned with the center line of the railroad car.

3. The improvement as claimed in claim 2, wherein each of said depressible sections comprises:

a predetermined length of guide rail; and means for biasing said guide rail upwardly toward a most upward position.

4. The improvement as claimed in claim 3 wherein each of said depressible sections further comprises a slotted channel through which said guide rail partially extends.

5. The improvement of claim 4 wherein said guide rail is sufficiently wide such that when said guide rail is in its most upward position, at least one-half of the width of said guide rail remains below the top of said channel.

6. The improvement as claimed in claim 5 wherein said biasing means includes:

a pair of springs, and a plurality of stops attached to the bottom of said guide rail for restricting the maximum upward movement of said rail through said slotted channel.

7. The improvement as claimed in claim 6 wherein each of said springs is cylindrically helical and has a circular cross-section.

8. In a railroad car arranged to transport automobiles, said railroad car comprising a floor, a roof, a pair of spaced sidewalls, at least one door assembly having a lower end and guide means for guiding the door assembly to a position adjacent a sidewall to enable loading and unloading of the railroad car, a rail for guiding the lower end of the door assembly, said rail positioned along the floor of the railroad car, means attached to the door assembly and extending to a sliding engagement with the rail, the improvement comprising said rail having uninterrupted sections and extending substantially entirely across the floor between the sidewalls and said rail having two spaced depressible sections spaced from a hypothetical center line of the railroad car an equal distance such that automobile wheels will travel over said sections when the center of an automobile is aligned with the center line of the railroad car, said depressible sections including a predetermined length of guide rail, means for biasing said guide rail upwardly toward a most upward position, and a slotted channel through which said guide rail partially extends, with said slotted channel including a base plate secured to the frame of the railroad car, an end angle attached to the base plate and having a slot in a horizontal web through which said guide rail partially extends, a support angle attached to the interior of said end angle adjacent one side of said guide rail, and a hinge support angle attached to said end angle and having a vertical web adjacent the opposite side of said guide rail and having a horizontal web extending outwardly toward the end of the railroad car and downwardly from the horizontal web of said end angle, whereby said depressible sections can be pushed down by the tires of the automobiles rolling thereover in both a loading and an unloading direction.

9. The improvement as claimed in claim 8 wherein said slotted channel further includes a plurality of angle braces.

10. The improvement as claimed in claim 8 which further includes a plurality of tube sections attached to the horizontal web of said hinge support angle.

11. The improvement as claimed in claim 10 wherein the outer diameter of each of said tube sections is less than the width of the vertical web of said hinge support angle.

12. The improvement of claim 8 wherein said guide rail is sufficiently wide such that when said guide rail is in its most upward position, at least one-half of the width of said guide rail remains below the top of said channel.

13. The improvement as claimed in claim 12 wherein said biasing means includes:

a pair of springs, and a plurality of stops attached to the bottom of said guide rail for restricting the maximum upward movement of said rail through said slotted channel.

14. The improvement as claimed in claim 13 wherein each of said springs is cylindrically helical and has a circular cross-section.

* * * * *